US008581895B2

(12) United States Patent
Nam

(10) Patent No.: US 8,581,895 B2
(45) Date of Patent: Nov. 12, 2013

(54) DATA DRIVER, DISPLAY APPARATUS AND DRIVING METHOD THEREOF

(75) Inventor: Hyoung Sik Nam, Incheon (KR)

(73) Assignee: Samsung Display Co., Ltd. (KR)

( * ) Notice: Subject to any disclaimer, the term of this patent is extended or adjusted under 35 U.S.C. 154(b) by 862 days.

(21) Appl. No.: 12/700,958

(22) Filed: Feb. 5, 2010

(65) Prior Publication Data

US 2011/0057914 A1 Mar. 10, 2011

(30) Foreign Application Priority Data

Sep. 8, 2009 (KR) ..... 10-2009-0084589

(51) Int. Cl.
*G09G 5/00* (2006.01)

(52) U.S. Cl.
USPC ..... 345/211; 345/98; 345/100

(58) Field of Classification Search
CPC ..... G09G 2300/00
USPC ..... 345/211
See application file for complete search history.

(56) References Cited

U.S. PATENT DOCUMENTS

| | | | | |
|---|---|---|---|---|
| 5,841,431 | A * | 11/1998 | Simmers | 345/211 |
| 7,843,400 | B2 * | 11/2010 | Nakai et al. | 345/1.3 |
| 2006/0262069 | A1 * | 11/2006 | Do et al. | 345/98 |
| 2007/0030230 | A1 | 2/2007 | Lee | |
| 2009/0027322 | A1 * | 1/2009 | Hosotani | 345/87 |
| 2010/0289791 | A1 * | 11/2010 | Weng | 345/213 |

FOREIGN PATENT DOCUMENTS

| | | |
|---|---|---|
| JP | 11-249633 | 9/1999 |
| JP | 11-338433 | 12/1999 |
| JP | 2007-041548 | 2/2007 |
| KR | 10-2007-0016059 | 2/2007 |

* cited by examiner

*Primary Examiner* — William Boddie
*Assistant Examiner* — Sahlu Okebato
(74) *Attorney, Agent, or Firm* — Cantor Colburn LLP

(57) ABSTRACT

A data driver includes data lines, data voltage output parts that output data voltages to the data lines, and a data voltage sharing part connected to the data lines. The data voltage sharing part connects output terminals of two or more of the data voltage output parts to each other to charge-share the data voltages therebetween.

18 Claims, 4 Drawing Sheets

DATA DRIVER, DISPLAY APPARATUS AND DRIVING METHOD THEREOF

This application claims priority to Korean Patent Application No. 10-2009-0084589, filed on Sep. 8, 2009, and all the benefits accruing therefrom under 35 U.S.C. §119, the content of which in its entirety is herein incorporated by reference.

BACKGROUND OF THE INVENTION (1) Field of the Invention

The present invention relates to a data driver, a display apparatus and a method of driving the display apparatus. More particularly, the present invention relates to a data driver having a substantially reduced power consumption, a display apparatus including the data driver, and a method of driving the display apparatus.

(2) Description of the Related Art

A liquid crystal display ("LCD") typically includes a liquid crystal panel including two substrates and a liquid crystal layer disposed between the two substrates. The liquid crystal display receives light from a light source and selectively transmits the light to display an image. To display the image, the liquid crystal display applies an electric field to liquid crystal molecules in the liquid crystal layer to selectively transmit the light therethrough.

In general, the liquid crystal display inverts a polarity of a data voltage (with respect to a common voltage) every frame, line or pixel to prevent deterioration of the liquid crystal molecules and/or flickering of the displayed image, which are caused by applying the electric field in only one direction. However, the abovementioned inversion schemes of switching the polarity of the data voltage cause a delay in a response speed of the liquid crystal molecules. As a result, operation of the liquid crystal molecules becomes slow, thereby causing blur in the displayed image. However, if the above-mentioned inversion schemes of switching the polarity of the data voltage are accelerated to increase the response speed of the liquid crystal molecules, power consumption increases. Thus, there is a need for a data driver having reduced power consumption.

BRIEF SUMMARY OF THE INVENTION

Exemplary embodiments of the present invention provide a data driver which has a substantially reduced power consumption.

Exemplary embodiments of the present invention also provide a display apparatus including the data driver.

Exemplary embodiments of the present invention further provide a method of driving the display apparatus including the data driver.

According to an exemplary embodiment, a data driver includes data lines, data voltage output parts that output data voltages to the data lines, and a data voltage sharing part that connects output terminals of the data voltage output parts to each other to charge-share the data voltages between the two or more data voltage output parts.

According to one or more exemplary embodiment embodiments, the data voltage sharing part outputs the data voltages to the data lines during an active period during which an effective data is transmitted to the data lines within a frame period, and the data voltage sharing part charge-shares the data voltages during a blank period during which a non-effective data is transmitted to the data lines.

Polarities of the data voltages are inverted every at least one data line.

According to one or more exemplary embodiment embodiments, data voltage sharing part includes: first switching devices, each of which is connected between a data line of the data lines and a corresponding data voltage output part of the data voltage output parts and controls an output of the data voltages in response to a first control signal; and second switching devices, each of which is connected between two adjacent output terminals of the output terminals of the data voltage output parts. The second switching devices electrically connect the two adjacent output terminals to each other in response to a second control signal to charge-share the data voltages.

According to one or more exemplary embodiment embodiments, the first switching devices are turned off during the blank period and the second switching devices are turned on during the blank period.

According to one or more exemplary embodiment embodiments, the data driver further includes: a power supply line which provides a driving power to each of the data voltage output parts; third switching devices, each of which is connected between the power supply line and a corresponding data voltage output part of the data voltage output parts to control a supply of the driving power to the corresponding data voltage output part in response to a third control signal; and a control signal line which provides the third control signal, set according to a charge-sharing operation of the data voltage sharing part, to the third switching devices.

According to one or more exemplary embodiment embodiments, the first switching devices are turned off during the blank period, the second switching devices are turned on during the blank period and the third switching devices are turned off during the blank period.

In an additional exemplary embodiment, a display apparatus includes a display panel including data lines, and a data driver which drives the data lines. The data driver includes: data voltage output parts which output data voltages to the data lines; and a data voltage sharing part connected to the data lines and which connects output terminals of two or more of the data voltage output parts to each other to charge-share the data voltages between the two or more data voltage output parts.

According to one or more exemplary embodiment embodiments, the data voltage sharing part outputs the data voltages to the data lines during an active period during which an effective data is transmitted to the data lines within a frame period, and the data voltage sharing part charge-shares the data voltages during a blank period during which a non-effective data is transmitted to the data lines.

According to one or more exemplary embodiment embodiments, polarities of the data voltages are inverted every at least one data line.

According to one or more exemplary embodiment embodiments, the data voltage sharing part includes: first switching devices, each of which is connected between a data line of the data lines and a corresponding data voltage output part of the data voltage output parts and controls an output of the data voltages in response to a first control signal; and second switching devices, each of which is connected between two adjacent output terminals of the output terminals of the data voltage output parts. The second switching devices control a charge-sharing operation of the data voltages in response to a second control signal.

According to one or more exemplary embodiment embodiments, the first switching devices are turned off during the blank period and the second switching devices are turned on during the blank period.

According to one or more exemplary embodiment embodiments, the display apparatus further includes: a power supply line which provides a driving power to each of the data voltage output parts; third switching devices, each of which is connected between the power supply line and a corresponding data voltage part of the data voltage output parts to control a supply of the driving power to the corresponding data voltage output part in response to a third control signal; and a control signal line which provides the third control signal, set according to the charge-sharing operation of the data voltage sharing part, to the third switching devices.

According to one or more exemplary embodiment embodiments, the first switching devices are turned off during the blank period, the second switching devices are turned on during the blank period and the third switching devices are turned off during the blank period.

According to one or more exemplary embodiment embodiments, the display apparatus further includes a timing controller which provides the first control signal, the second control signal and the third control signal to the data driver.

According to one or more exemplary embodiment embodiments, the timing controller detects a repeat of the data voltages during a plurality of the frame periods to turn off the second switching devices and the third switching devices during the blank period based on the repeat of the data voltages.

In yet another exemplary embodiment, in a method of driving a display apparatus, which includes data lines and a data driver which outputs data voltages to the data lines, the method includes: receiving an image data including a plurality of frames; detecting, from the image data, a frame of the plurality of frames which corresponds to a raw image and a frame of the plurality of frames which corresponds to a repeated image; setting the frame which corresponds to the raw image as an active period and the frame which corresponds to the repeated image as a blank period; and outputting the data voltages corresponding to the raw image during the active period and charge-sharing the data voltages corresponding to the repeated image during the blank period.

According to one or more exemplary embodiment embodiments, the method further includes cutting off a driving power to the data driver during the blank period.

According to one or more exemplary embodiment embodiments, when n repeated frames are detected among the image data (where n is a natural number greater than 1), a first frame of the n frames is set as the active period, and remaining n−1 frames of the n frames are set as the blank period.

Thus, a driving power provided to the data driver is cut off through the charge-sharing of the data voltage during the blank period, since the data driver includes the data voltage sharing part, thereby substantially reducing a power consumption of the data driver according to one or more exemplary embodiments as described herein.

BRIEF DESCRIPTION OF THE DRAWINGS

The above and other aspects of the present invention will become more readily apparent by describing in further detail exemplary embodiments thereof with reference to the accompanying drawings, in which.

DETAILED DESCRIPTION OF THE INVENTION

Figure 1:
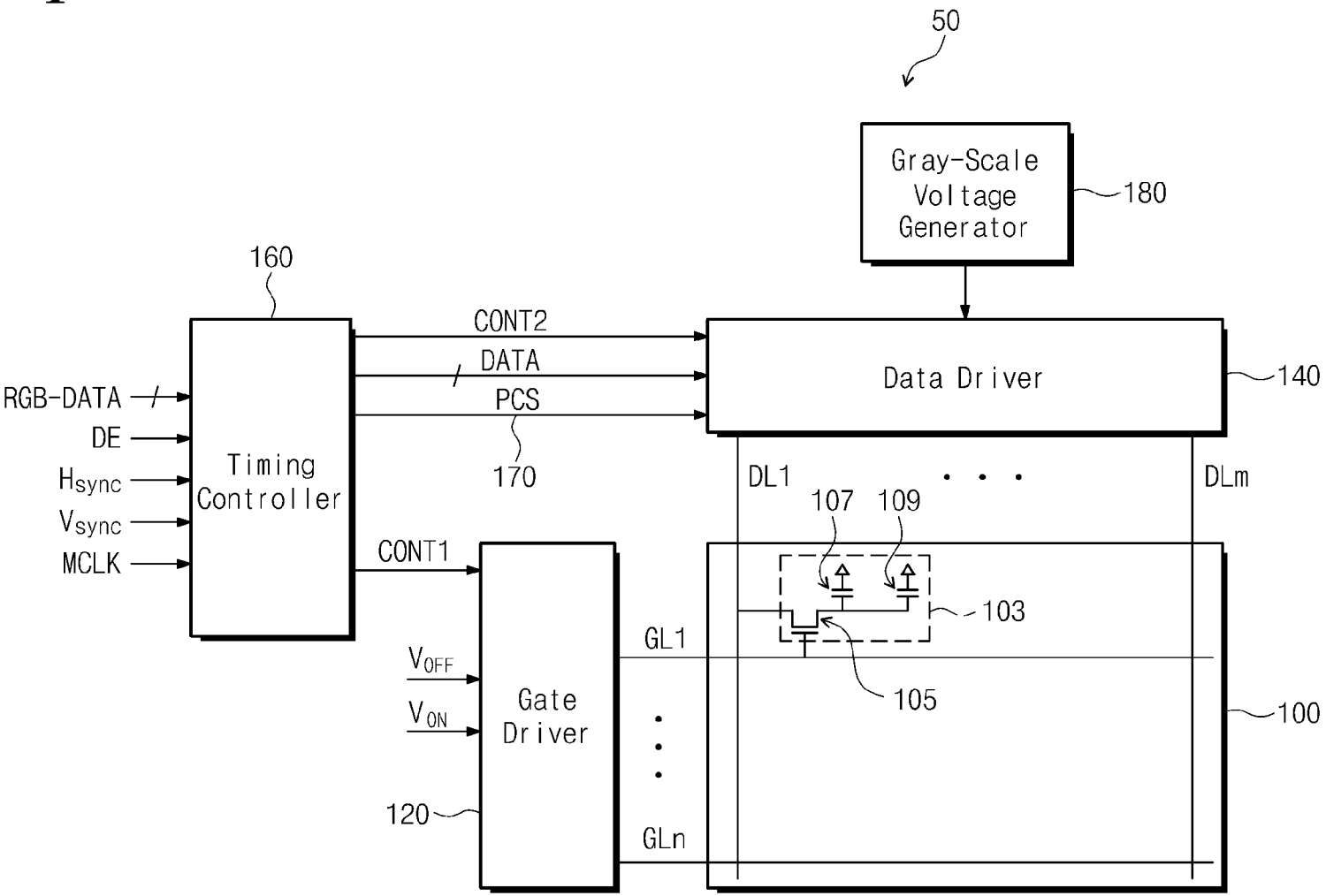
FIG. 1 is a block diagram of an exemplary embodiment of a display apparatus according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the present invention will be described in further detail with reference to the accompanying drawings.

FIG. 1 is a block diagram of an exemplary embodiment of a display apparatus according to the present invention.

Referring to FIG. 1, a display apparatus 50 includes a display panel 100 displaying an image, a gate driver 120 and a data driver 140 that drives the display panel 100, a gray-scale voltage generator 180 connected to the data driver 140, and a timing controller 160 that controls the gate driver 120 and the data driver 140.

The display panel 100 includes a plurality of gate lines GL1-GLn that receives gate voltages and a plurality of data lines DL1-DLm that receives data voltages. The display panel 100 includes a plurality of pixel areas arranged in a matrix configuration, and pixels 103 disposed in the pixel areas. Each pixel 103 includes a thin film transistor 105, a liquid crystal capacitor 107 and a storage capacitor 109. In one or more exemplary embodiments, the pixels 103 have substantially the same structure and function, thus one pixel 103 of the pixels 103 will now be described in greater detail in association with a first gate line GL1 of the plurality of gate lines GL1-GLn and a first data line DL1 of the plurality of data lines DL1-DLm as a representative example.

As shown in FIG. 1, the thin film transistor 105 includes a gate electrode connected to the first gate line GL1, a source electrode connected to the first data line DL1 and a drain electrode connected to the liquid crystal capacitor 107 and the storage capacitor 109, which are connected in parallel with each other between the drain electrode and ground.

In an exemplary embodiment, the display panel 100 includes a first display substrate (not shown), a second display substrate (not shown) facing the first display substrate and a liquid crystal layer (not shown) disposed between the first display substrate and the second display substrate.

The plurality of gate lines GL1-GLn, the plurality of data lines DL1-DLm, the thin film transistor 105 and a pixel electrode (not shown), which serves as a first electrode of the liquid crystal capacitor 107, are disposed on the first display substrate. The thin film transistor 105 supplies a data voltage of the data voltages to a pixel electrode of a corresponding pixel 103 in response to a corresponding gate voltage of the gate voltages.

In addition, a common electrode (not shown) serves as a second electrode of the liquid crystal capacitor 107, and is disposed on the second display substrate. A common voltage VCOM is supplied to the common electrode. The liquid crystal layer, disposed between the pixel electrode and the common electrode, serves as a dielectric. The liquid crystal capacitor 107 is charged with a voltage corresponding to an electric potential difference between the data voltage and the common voltage.

The gate driver 120 is electrically connected to the plurality of gate lines GL1-GLn disposed in the display panel 100 to apply the gate voltages to corresponding gate lines GL1-GLn of the plurality of gate lines GL1-GLn.

The data driver 140 is electrically connected to the plurality of data lines DL1-DLm, which are disposed in the display panel 100, and selects a gray-scale voltage provided from the gray-scale voltage generator 180 to apply the selected gray-scale voltage to each data line DL1-DLm of the plurality of data lines DL1-DLm as the data voltages.

The timing controller 160 receives a main image data RGB-DATA and various control signals, such as a vertical synchronization signal Vsync, a horizontal synchronization signal Hsync, a main clock MCLK and a data enable signal DE from an external source, such as a graphic controller (not shown). The timing controller 160 processes the main image data RGB-DATA and outputs the processed main image data RGB-DATA as image data DATA, and outputs a gate control signal CONT1 and a data control signal CONT2 based on the various control signals.

The gate control signal CONT1 is supplied to the gate driver 120 to control an operation of the gate driver 120. The gate control signal CONT1 includes a vertical start signal for starting an operation of the gate driver 120, a gate clock signal indicating an output timing of the gate voltage and an output enable signal for deciding a pulse width of the gate voltage.

The gate driver 120 outputs the gate voltage, including a gate-on voltage VON and a gate-off voltage VOFF, in response to the gate control signal CONT1 provided from the timing controller 160.

The data control signal CONT2 is supplied to the data driver 140 to control an operation of the data driver 140. The data control signal CONT2 includes a vertical start signal for starting an operation of the data driver 140, a polarity inverting signal POL (FIG. 3) for inverting a polarity of the data voltage and an output indicating signal TP (FIG. 3) for indicating an output timing of the data voltage from the data driver 140.

The data driver 140 receives the image data DATA corresponding to pixels 103 connected to one row of pixels 103 in response to the data control signal CONT2 provided from the timing controller 160 and selects the gray-scale voltage corresponding to the image data DATA from among the gray-scale voltages provided from the gray-scale voltage generator 180. In addition, the data driver 140 converts the selected gray-scale voltage into the data voltages and outputs the data voltages.

The data driver 140 is connected to the timing controller 160 through a control signal line 170 to control a driving power that is used to output the data voltages. In addition, the data driver 140 receives a driving power control signal PCS from the timing controller 160 through the control signal line 170. The data driver 140 according to an exemplary embodiment will now be described in further detail with reference to FIG. 2.

Figure 2:
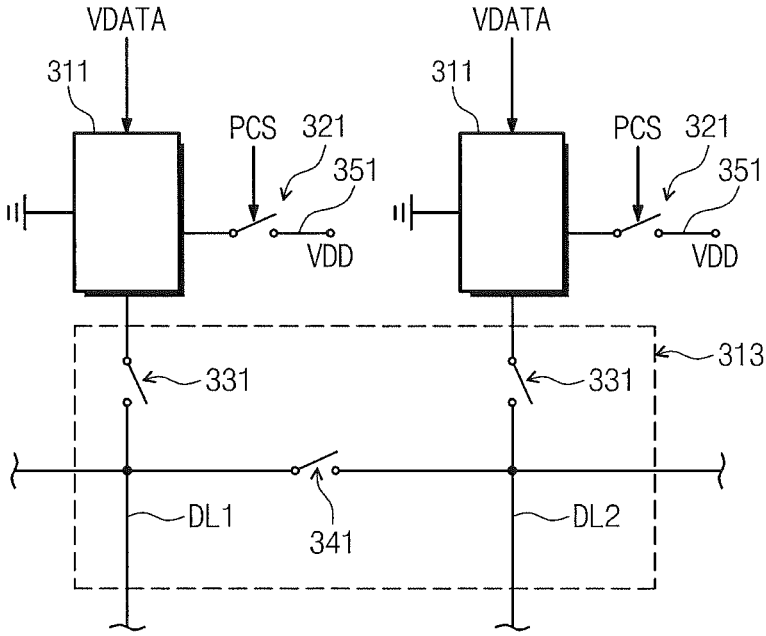
FIG. 2 is a block diagram of an exemplary embodiment of a data driver according to the present invention.

FIG. 2 is a block diagram of an exemplary embodiment of the data driver 140 according to the present invention.

Referring to FIG. 2, the data driver 140 includes a plurality of data voltage output parts 311 that outputs data voltages VDATA (FIG. 3) to the data lines DL1-DLm and a data voltage sharing part 313 connected to the data lines DL1-DLm and connecting output terminals of each of the data voltage output parts 311 of the plurality of data voltage output parts 311 to each other to charge-share the data voltages VDATA. In an exemplary embodiment, the data voltage output parts 311 have substantially the same structure and function, and thus only two data voltage output parts 311 will hereinafter be described in further detail as representatives of all of the data voltage output parts 311 included in one or more exemplary embodiments.

The data voltage sharing part 313 first switching devices 331, each of which is connected between a corresponding data line DL of the plurality of data lines DL1-DLm and a corresponding data voltage output part 311 of the data voltage output parts 311, second switching devices 341, each of which is connected between two adjacent data lines (e.g., a first data line DL1 and a second data line DL2, as shown in FIG. 2) of the plurality of data lines DL1-DLm, a power supply line 351 that provides a driving power VDD to the data voltage output parts 311, and third switching devices 321 that control a supply of the driving power VDD to the data voltage output parts 311.

The data voltage output parts 311 output the data voltages VDATA based on the image data DATA provided from the timing controller 160 to the corresponding data lines DL1 and DL2.

As shown in FIG. 2, for example, the first switching device 331 is connected between the data line DL1 and a corresponding data voltage output part 311 and between the data line DL2 and a corresponding data voltage output part 311 to control an output of the data voltages VDATA.

Each of the second switching devices 341 is connected between the two adjacent data lines DL1 and DL2 to control a charge-sharing operation between the two adjacent data lines DL1 and DL2.

The power supply line 351 provides power, e.g., voltage or current, to the data voltage output parts 311 to drive the data voltage output parts 311.

The third switching devices 321 are connected between the power supply line 351 and the data voltage output parts 311 to control a supply of the driving power VDD in response to an operation of the first switching device 331 and the second switching device 341.

The data driver 140 outputs the data voltages VDATA, which have a positive polarity or a negative polarity, to the data lines DL1-DLm during a plurality of frame periods.

Each frame period of the plurality of frame periods is divided into an active period AP, during which an effective data is transmitted, and a blank period BP, during which a non-effective data is transmitted. More specifically, during the blank period BP, the data voltages VDATA are not supplied to the liquid crystal panel. Thus, a data previously provided to the liquid crystal panel is maintained during the blank period BP.

In addition, the blank period BP includes a horizontal blank period, associated with the gate lines GL1-GLn, and a vertical blank period BP, associated with the frame periods. For purposes of description herein, blank period will be assumed to refer to the vertical blank period, and when a distinction between the vertical blank period BP and the horizontal blank period BP is required, such distinction will be noted.

During the active period AP, the data voltages VDATA are applied to the pixels 103 (FIG. 1) connected to the data lines DL1-DLm, and the data voltage output parts 311 connected to the data lines DL1 and DL2 (FIG. 2) apply the data voltages VDATA to the data lines DL1 and DL2. In contrast, during the blank period BP, the data voltage output parts 311 do not apply the data voltages VDATA to the data lines DL1 and DL2. Thus, in an exemplary embodiment, power consumption is substantially reduced due to the blank period BP.

Figure 3:
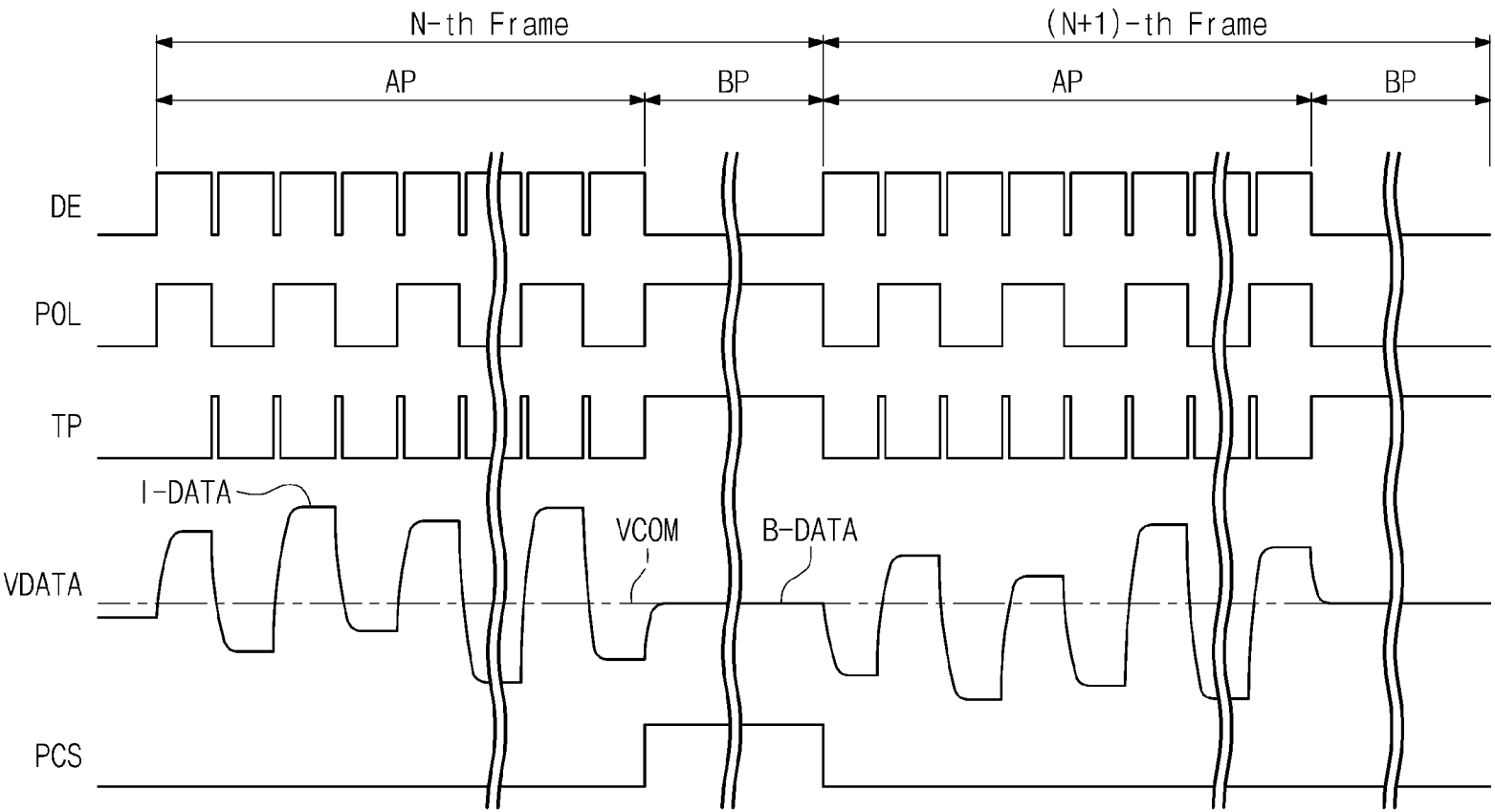
FIG. 3 is a signal timing diagram illustrating an operation of an exemplary embodiment of a display apparatus according to the present invention.

During the blank period BP, the data driver 140 outputs the data voltages VDATA having substantially the same voltage level as a voltage level of the common voltage VCOM (FIG. 3). Since the data voltages VDATA have the same voltage level as the common voltage VCOM, a polarity of the data voltages VDATA is not required to be inverted during the blank period BP. The data driver 140 controls the data lines DL1 and DL2 to charge-share the charges therebetween, so that the data voltages VDATA may have the same voltage level as the common voltage VCOM during the blank period BP. Put another way, the data lines DL1 and DL2, to which the data voltages VDATA, having the positive polarity or the negative polarity, are applied, charge-share the charge therebetween based on operation of the data driver 140. As a result of the charge-sharing, the data voltages VDATA applied to the data lines DL1 and DL2 have, on average, substantially the same voltage level as the common voltage VCOM. More specifically, and referring to FIGS. 1 and 2, the data driver 140 turns off the first switching devices 331, using a first control signal, during the blank period BP and turns on the second switching devices 341, using a second control signal, during the blank period BP.

Since the data driver 140 does not output the data voltages VDATA through the data voltage output parts 311 during the blank period BP, the driving power provided to the data voltage output parts 311 during the active period AP may be cut off. To cut off the driving power, the data driver 140 turns off the third switching devices 321, using a third control signal, which, in an exemplary embodiment is the driving power control signal PCS, based on the operation of the first switching device 331 and the second switching device 341 during the blank period BP.

Thus, the data driver 140 substantially reduces the power consumption of the data voltage output parts 311 by turning off the third switching devices 321, thereby cutting off the driving power VDD supplied thereto.

Hereinafter, an operation of an exemplary embodiment of a display apparatus will be described in further detail with reference to FIG. 3.

FIG. 3 is a signal timing diagram illustrating an operation of an exemplary embodiment of a display apparatus according to the present invention. In FIG. 3, the operation of the display apparatus during an N-th frame period and an (N+1)-th frame period, which is successive and adjacent to the N-th frame period, will be described.

Referring to FIG. 3, the timing controller 160 (FIG. 1) receives the data enable signal DE from an external source (not shown) and outputs a polarity inverting signal POL, an output indicating signal TP, and the driving power control signal PCS to the data driver 140. The data driver 140 outputs data voltages VDATA to the data lines DL1-DLm in response to the polarity inverting signal POL and the output indicating signal TP.

The data enable signal DE is maintained at a high level, corresponding to an active period AP, within the N-th frame period, and is maintained at a low level, corresponding to a blank period BP, within the N-th frame period. More particularly, the data enable signal DE is maintained at the high level during sub-active periods (not shown), each corresponding to the pixels 103 (FIG. 1) disposed in one row and is maintained at the low level during a horizontal blank period (not shown) between the sub-active periods.

The polarity inverting signal POL transitions between the high level and the low level based on the data enable signal DE. Specifically, the polarity inverting signal POL transitions between the high level and the low level corresponding to the sub-active periods of the data enable signal DE to invert the polarity of the data voltages VDATA on a pixel unit basis.

The output indicating signal TP is maintained at the high level, corresponding to the horizontal blank period BP, during the active period AP, and is otherwise maintained at the low level, which corresponds to the sub-active periods (not shown). The output indicating signal TP indicates the supply of the data voltages VDATA. The output indicating signal TP is maintained at the high level during the blank period BP to indicate the charge-sharing operation of the data voltages VDATA with the polarity inverting signal POL.

The data voltages VDATA are supplied to the data lines DL1 and DL2 (FIG. 2) as image data I-DATA (FIG. 3) having a positive polarity or a negative polarity in response to the polarity inverting signal POL and the output indicating signal TP during the active period AP. During the blank period BP, the data voltages VDATA are supplied to the data lines DL1 and DL2 as black data B-DATA, having substantially the same voltage level as the common voltage VCOM, in response to the polarity inverting signal POL and the output indicating signal TP.

The driving power control signal PCS is maintained at the high level corresponding to the charge-share of the data voltages VDATA during the blank period BP, and turns off the third switching devices 321 (FIG. 2), connected to the data voltage output parts 311 of the data driver 140 (FIG. 1). Thus, the third switching devices 321 stop applying, e.g., cut off, the driving power VDD to the data voltage output parts 311 in response to the driving power control signal PCS having the high level.

Thus, in the exemplary embodiments described herein, the data voltages VDATA are charge-shared between the data lines DL1 and DL2 in response to a transition of the polarity inverting signal POL and the output indicating signal TP during the blank period BP. Thus, the display apparatus according to an exemplary embodiment has substantially reduced power consumption, since the driving power VDD provided to the data driver 140 is cut off during the charge-sharing operation of the data lines DL1 and DL2.

Figure 4:
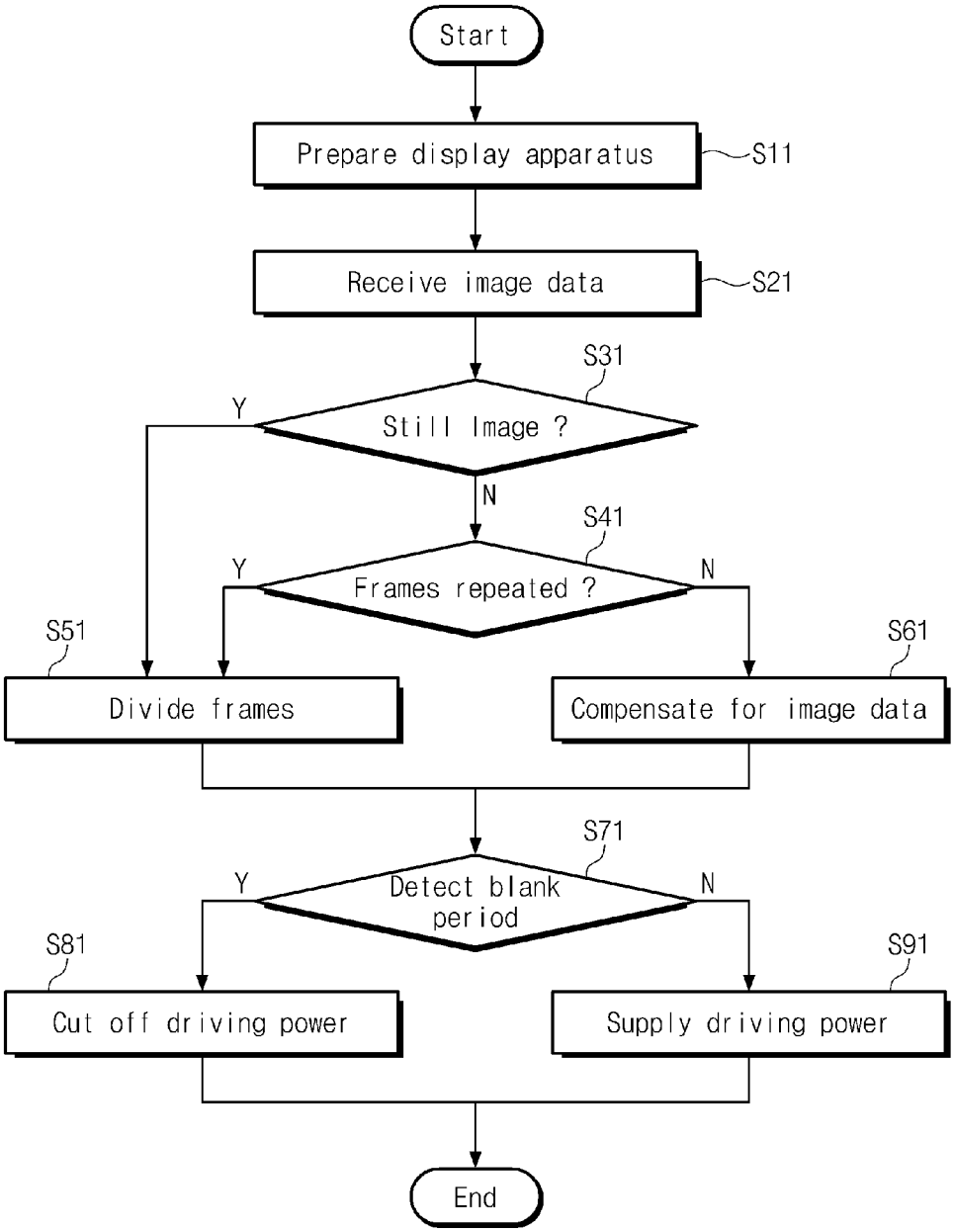
FIG. 4 is a flowchart illustrating an exemplary embodiment of a method of driving a display apparatus according to the present invention.

FIG. 4 is a flowchart illustrating an exemplary embodiment of a method of driving a display apparatus according to the present invention.

Referring to FIGS. 1 and 4, in step S11, the display apparatus 50 including the display panel 100 on which the data lines DL1-DLm are disposed, the data driver 140 connected to the data lines DL1-DLm, and the timing controller 160 that supplies the control signals to the data driver 140 is prepared.

In step S21, the timing controller 160 receives the image data including the frames from an external source, such as a graphic controller (not shown). The image data provided to the display apparatus 50 includes both a raw image, which may be either a still image or a moving image, as well as repeated images (still and/or moving), and may have a frame frequency of about 60 hertz (Hz), although additional exemplary embodiments are not limited thereto.

The timing controller 160 determines whether the received image data corresponds to a still image or a moving image in step S31.

In step S51, if the image data is for a still image, the timing controller 160 detects a number of frames repeated in the still image data and divides the still image data into a first frame and a remaining frame (or frames) from among the repeated frames. The first frame of the repeated frames is set as the active period AP, and the remaining frame (or frames) is set as the blank period BP.

In step S41, if the image data is for a moving image, the timing controller 160 checks whether the frames are repeated in the moving image data. When repeated frames exist in the moving image data, the moving image data is divided into a first frame and a remaining frame (or frames) of the repeated frames, in step S51 (mentioned above). The first frame of the repeated frames is set as the active period AP, and the remaining frame is set as the blank period BP.

When no repeated frames exist in the moving image data, in step S61, the timing controller 160 inserts a compensation frame between the frames of the moving image data to compensate the moving image data. The compensation frame includes image data corresponding to an intermediate frame between two adjacent frames of the moving image data.

In step S71, the timing controller 160 detects the frames set as the blank period BP among the frames of the image data (either from the moving image or the still image). In step S81, the data driver 140 transitions to the charge-sharing mode, based on an operation of the timing controller 160 during the frames set as the blank period BP, and the driving power VDD is no longer provided to the data driver 140, e.g., is thereby cut off.

When the timing controller 160 detects the frames set as the active period AP among the frames of the image data, the timing controller 160 provides the driving power VDD to the data driver 140 during the frames set as the active period AP to normally operate the data driver 140, as shown in step S91.

As a frame frequency of the image data increases, and a number of frames set as the blank period BP increases, the timing controller 160 increases the time period during which the driving power VDD is cut off. Specifically, when the timing controller 160 compensates for the image data having a frame frequency of 60 Hz to image data having a frame frequency of 120 Hz, for example, the number of frames set as the blank period BP increases, thereby further reducing the driving power VDD consumed by the data driver 140.

Additionally, the graphic controller (not shown) may also control a length of the blank period BP according to the image data to change the frame frequency. Specifically, the graphic controller may increase the length of the blank period BP in image data having a frame frequency of 60 Hz to allow the image data to have a frame frequency of about 40 Hz, for example. Thus, the length of the blank period BP in the image data having the changed frame frequency of about 40 Hz is about 30 percent (%) longer than the length of the blank period BP in the image data having the frame frequency of 60 Hz. Therefore, when the display apparatus 50 displays the image data having the frame frequency of 40 Hz, the driving power VDD consumed by the data driver 140 may be further reduced, as compared with the driving power VDD consumed by the data driver 140 when the display apparatus 50 displays the image data having the frame frequency of 60 Hz. Moreover, only the length of the blank period BP is changed in the image data having the frame frequency of 40 Hz; accordingly, there is no need to check the type of the image data.

Thus, according to exemplary embodiments of the driving method of the display apparatus described herein, the timing controller 160 detects repeated frames from image data provided from an external source and sets the detected frames as the blank period BP to cut off the driving power VDD provided to the data driver 140. Therefore, the power consumption of the data driver 140 in the display apparatus 50 is substantially reduced.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A data driver comprising:

data lines;

data voltage output parts which output data voltages to the data lines;

a data voltage sharing part connected to the data lines and which connects output terminals of two or more of the data voltage output parts to each other to charge-share the data voltages between the two or more data voltage output parts;

a power supply line which provides a driving power to each of the data voltage output parts; and switching devices, each of which is connected between the power supply line and a corresponding data voltage output part of the data voltage output parts to control a supply of the driving power to the corresponding data voltage output part in response to a control signal, wherein the supply of driving power to the corresponding data voltage output part is turned off during a charge-sharing operation of the data voltage sharing part.

2. The data driver of claim 1, wherein the data voltage sharing part outputs the data voltages to the data lines during an active period during which an effective data is transmitted to the data lines within a frame period, and the data voltage sharing part charge-shares the data voltages during a blank period during which a non-effective data is transmitted to the data lines.

3. The data driver of claim 1, wherein polarities of the data voltages are inverted every at least one data line.

4. The data driver of claim 2, wherein the data voltage sharing part comprises:

first switching devices, each of which is connected between a data line of the data lines and a corresponding data voltage output part of the data voltage output parts and controls an output of the data voltages in response to a first control signal; and second switching devices, each of which is connected between two adjacent output terminals of the output terminals of the data voltage output parts, wherein the second switching devices electrically connect the two adjacent output terminals to each other in response to a second control signal to charge-share the data voltages.

5. The data driver of claim 4, wherein the first switching devices are turned off during the blank period and the second switching devices are turned on during the blank period.

6. The data driver of claim 4, further comprising:

a control signal line which provides the third control signal, set according to the charge-sharing operation of the data voltage sharing part, to the switching devices.

7. The data driver of claim 6, wherein the first switching devices are turned off during the blank period, the second switching devices are turned on during the blank period and the switching devices are turned off during the blank period.

8. A display apparatus comprising:

a display panel including data lines; and a data driver which drives the data lines, wherein the data driver comprises:

data voltage output parts which output data voltages to the data lines;

a data voltage sharing part connected to the data lines and which connects output terminals of two or more of the data voltage output parts to each other to charge-share the data voltages between the two or more data voltage output parts;

a power supply line which provides a driving power to each of the data voltage output parts; and switching devices, each of which is connected between the power supply line and a corresponding data voltage output part of the data voltage output parts to control a supply of the driving power to the corresponding data voltage output part in response to a control signal, wherein the supply of driving power to the corresponding data voltage output part is turned off during a charge-sharing operation of the data voltage sharing part.

9. The display apparatus of claim 8, wherein the data voltage sharing part outputs the data voltages to the data lines during an active period during which an effective data is transmitted to the data lines within a frame period, and the data voltage sharing part charge-shares the data voltages during a blank period during which a non-effective data is transmitted to the data lines.

10. The display apparatus of claim 8, wherein polarities of the data voltages are inverted every at least one data line.

11. The display apparatus of claim 9, wherein the data voltage sharing part comprises:

first switching devices, each of which is connected between a data line of the data lines and a corresponding data voltage output part of the data voltage output parts and controls an output of the data voltages in response to a first control signal; and second switching devices, each of which is connected between two adjacent output terminals of the output terminals of the data voltage output parts, wherein the second switching devices control a charge-sharing operation of the data voltages in response to a second control signal.

12. The display apparatus of claim 11, wherein the first switching devices are turned off during the blank period and the second switching devices are turned on during the blank period.

13. The display apparatus of claim 11, further comprising:

a control signal line which provides the third control signal, set according to the charge-sharing operation of the data voltage sharing part, to the switching devices.

14. The display apparatus of claim 13, wherein the first switching devices are turned off during the blank period, the second switching devices are turned on during the blank period and the switching devices are turned off during the blank period.

15. The display apparatus of claim 13, further comprising a timing controller which provides the first control signal, the second control signal and the third control signal to the data driver.

16. The display apparatus of claim 15, wherein the timing controller detects a repeat of the data voltages during a plurality of the frame periods to turn off the second switching devices and the switching devices during the blank period based on the repeat of the data voltages.

17. A method of driving a display apparatus comprising data lines and a data driver which outputs data voltages to the data lines, the method comprising:

receiving an image data including a plurality of frames;

setting the frame which corresponds to the raw image as an active period and the frame which corresponds to the repeated image as a blank period; and outputting the data voltages corresponding to the raw image during the active period and charge-sharing the data voltages corresponding to the repeated image during the blank period;

wherein cutting off a driving power to the data driver during the blank period.

18. The method of claim 17, wherein, when n repeated frames are detected among the image data, where n is a natural number greater than 1, a first frame of the n frames is set as the active period, and remaining n-1 frames of the n frames are set as the blank period.

* * * * *